US008186755B2

(12) United States Patent
Lovley

(10) Patent No.: US 8,186,755 B2
(45) Date of Patent: May 29, 2012

(54) COLLAPSIBLE CANOPY ALONG WITH ARTICLE OF FURNITURE AND METHOD INCORPORATING THE SAME

(75) Inventor: Jack Lovley, Lake Forest, CA (US)

(73) Assignee: Bravo Sports, Santa Fe Springs, CA (US)

( * ) Notice: Subject to any disclaimer, the term of this patent is extended or adjusted under 35 U.S.C. 154(b) by 80 days.

(21) Appl. No.: 12/333,713

(22) Filed: Dec. 12, 2008

(65) Prior Publication Data

US 2010/0102600 A1 Apr. 29, 2010

Related U.S. Application Data

(60) Provisional application No. 61/108,448, filed on Oct. 24, 2008.

(51) Int. Cl.
*A47C 7/62* (2006.01)
*E04H 15/64* (2006.01)
*E04H 15/48* (2006.01)

(52) U.S. Cl. ..... 297/184.15; 135/119; 135/151

(58) Field of Classification Search ..... 297/184.1, 297/184.15, 184.16, 452.13, 376, 16.2, 16.1, 297/440.11, 228.12, 452.63, 411.36, 440.24; 135/139, 140, 141, 142, 119, 143, 151; 403/221, 403/225; 248/222.11, 222.12, 316.2, 315
See application file for complete search history.

(56) References Cited

U.S. PATENT DOCUMENTS

| | | | | |
|---|---|---|---|---|
| 33,398 | A | 10/1861 | Miller | |
| 574,235 | A * | 12/1896 | Bennitt | 135/88.04 |
| 900,572 | A | 10/1908 | Morton | |
| 1,024,176 | A | 4/1912 | Boyens | |
| 1,075,372 | A | 10/1913 | Overshiner | |
| 1,256,902 | A | 2/1918 | Howe | |
| 1,341,689 | A | 6/1920 | Walmsley | |
| 1,429,043 | A | 9/1922 | Martin | |
| 1,443,921 | A | 1/1923 | Mackenzie | |
| 1,605,679 | A | 11/1926 | McGrail | |
| 1,639,074 | A | 8/1927 | Blackwood | |

(Continued)

FOREIGN PATENT DOCUMENTS

AU A 15170/92 12/1993

(Continued)

OTHER PUBLICATIONS

U.S. Appl. No. 60/467,698, filed May 1, 2003, Churchill.

(Continued)

*Primary Examiner* — Milton Nelson, Jr.
(74) *Attorney, Agent, or Firm* — Holland & Hart LLP

(57) ABSTRACT

A canopy for an article of furniture, such as a chair, having a seat portion and a back portion. The canopy includes a pair of arm structure and a flexible covering extending therebetween. Each arm structure includes an upright member including a proximal end portion extending from the back portion of the chair, a distal end portion, and a medial portion extending therebetween. The arm structure also includes a cantilever member pivotable about the distal end portion and a brace pivotably attached to the cantilever member and selectively positionable along the medial portion, thereby providing angle adjustment of the cantilever member relative to the seat portion. The flexible covering may include a plurality of panel sections, extending between the pair of arm structures and retained thereto by a pair of tethers or tabs each connecting to one of the cantilever members.

10 Claims, 9 Drawing Sheets

U.S. PATENT DOCUMENTS 1,763,455 A 6/1930 Bruijn
1,789,090 A 1/1931 Wawrunek
1,915,504 A 6/1933 Stokby
2,001,252 A 5/1935 Johnson
2,070,484 A 2/1937 Jones
2,137,427 A 11/1938 Thomson
2,166,832 A 7/1939 Wenker
2,243,984 A 6/1941 Singewald
2,429,763 A 10/1947 Lindabury
2,490,367 A 12/1949 Maddocks
2,545,968 A 3/1951 Newstead
2,561,886 A * 7/1951 Rikelman ..... 297/357
2,658,562 A 11/1953 Androsiglio
D171,176 S 12/1953 Yellen
2,689,603 A 9/1954 Smith
2,712,349 A 7/1955 Voir
2,729,276 A 1/1956 Volney
2,747,653 A 5/1956 Obradovich
D180,210 S 4/1957 Uretsky
2,819,776 A 1/1958 Balsam
2,926,724 A 3/1960 Rittenberg
3,007,735 A 11/1961 Cohn
3,034,523 A * 5/1962 De Shano ..... 297/17
3,092,224 A 6/1963 O'Neil
3,151,909 A 10/1964 Gerdetz
3,179,465 A 4/1965 Roberts
3,214,217 A 10/1965 Jente
3,243,230 A 3/1966 Otto
3,307,758 A 3/1967 Platt
3,309,134 A 3/1967 Roberts
3,333,595 A 8/1967 Bannister
3,339,566 A * 9/1967 Bowden ..... 297/184.11
3,404,915 A 10/1968 Filho
3,450,432 A 6/1969 Minsker
3,544,157 A 12/1970 Muller
3,580,633 A 5/1971 Du Priest
3,637,086 A 1/1972 Klein
3,879,086 A 4/1975 Moceri
3,918,109 A 11/1975 Barraclough
3,931,918 A 1/1976 Smith et al.
3,935,874 A 2/1976 Cohen
3,947,903 A 4/1976 Menke
4,030,748 A 6/1977 Brock
4,047,752 A 9/1977 Rohr
4,063,318 A 12/1977 Nicholson
4,082,102 A 4/1978 Heuer
4,201,416 A 5/1980 Vanderminden
4,248,255 A 2/1981 Arrowsmith
4,251,106 A 2/1981 Gilbert
D261,332 S 10/1981 Rohr
4,293,162 A 10/1981 Pap et al.
4,295,481 A 10/1981 Gee
4,300,798 A 11/1981 Musgrove et al.
4,487,345 A 12/1984 Pierce et al.
4,530,451 A 7/1985 Hamilton
4,635,667 A 1/1987 Harn
4,639,036 A 1/1987 Nichols
4,639,958 A 2/1987 Lerner
4,641,883 A 2/1987 Kato
D289,473 S 4/1987 Myers
4,687,248 A 8/1987 Ross et al.
4,687,249 A 8/1987 Mills
4,736,825 A 4/1988 Belfi
4,773,574 A 9/1988 Burgard
4,795,068 A 1/1989 Blean
4,796,734 A 1/1989 Distasio
4,809,724 A 3/1989 Fuser
4,810,029 A 3/1989 Kaladis et al.
4,824,171 A 4/1989 Hollingsworth
4,858,990 A 8/1989 Combs-Rose et al.
4,865,381 A 9/1989 Van Rogue
4,870,984 A 10/1989 Roth
4,885,812 A 12/1989 Lindner
4,889,383 A 12/1989 Jones
4,915,120 A 4/1990 Ziolkowski
4,924,896 A 5/1990 Carter
D310,605 S 9/1990 Kwon
4,971,089 A 11/1990 Braman
4,972,981 A 11/1990 Gex
5,000,210 A 3/1991 Worthington, Jr.
5,013,085 A 5/1991 Craig
5,022,420 A 6/1991 Brim
5,042,874 A 8/1991 Williams
5,080,432 A 1/1992 Connell
5,096,257 A 3/1992 Clark
5,102,190 A 4/1992 Akin et al.
5,135,281 A 8/1992 Pappalardo
5,139,308 A 8/1992 Ziman
5,154,473 A 10/1992 Joranco
5,203,363 A 4/1993 Kidwell et al.
5,205,308 A 4/1993 Kendall et al.
5,209,381 A 5/1993 Jay
5,240,020 A 8/1993 Byers
5,244,250 A 9/1993 Nordmeyer
D339,937 S 10/1993 Ryan
5,289,958 A 3/1994 Jay
5,299,337 A 4/1994 Venza
5,303,975 A 4/1994 Asato
5,320,405 A 6/1994 Foster et al.
5,350,215 A 9/1994 DeMars
5,362,130 A 11/1994 Hoffman
5,395,157 A 3/1995 Rollo et al.
D360,535 S 7/1995 Sjoberg
5,433,502 A 7/1995 Condorodis et al.
5,441,067 A 8/1995 James et al.
5,449,014 A 9/1995 Yan-ho
5,516,193 A 5/1996 Simpson
5,533,654 A 7/1996 Holty et al.
5,538,318 A 7/1996 MacLean
5,538,319 A 7/1996 DiMurro
5,544,793 A 8/1996 Harrop
5,547,246 A 8/1996 Lambert
5,551,110 A 9/1996 Armstrong et al.
5,564,452 A 10/1996 Kitchen
5,579,797 A * 12/1996 Rogers ..... 135/90
5,582,458 A 12/1996 Wildt
5,593,205 A 1/1997 Vanderminden, Sr. et al.
5,597,101 A 1/1997 Barber et al.
5,626,271 A 5/1997 Messey et al.
D380,306 S 7/1997 Lin
D382,126 S 8/1997 Lee
D382,414 S 8/1997 Lee
5,695,100 A 12/1997 O'Brien
5,718,473 A 2/1998 Lynch, Jr.
5,722,717 A 3/1998 Rettenberger
5,797,650 A 8/1998 Gonzalez, Jr. et al.
5,819,999 A 10/1998 Tennant
5,833,310 A 11/1998 Labelle
5,873,625 A 2/1999 Uchtman
5,921,258 A 7/1999 Francois
5,951,103 A 9/1999 Barnhill
5,961,178 A 10/1999 Hodson
5,967,601 A 10/1999 Gillins
5,975,626 A 11/1999 Aycock
5,984,406 A 11/1999 Lee
6,036,262 A 3/2000 Shahid
6,045,177 A 4/2000 Grace
6,082,813 A 7/2000 Chen
6,095,172 A 8/2000 Trapp et al.
6,102,479 A 8/2000 Wallace
6,152,156 A * 11/2000 Tung ..... 135/21
6,164,726 A 12/2000 Reeves et al.
6,206,463 B1 3/2001 Whigham
6,241,311 B1 6/2001 Zheng
6,250,712 B1 6/2001 Livington et al.
6,264,271 B1 7/2001 Munn et al.
6,276,382 B1 8/2001 Bindschatel et al.
6,296,002 B1 10/2001 Tashchyan
6,328,131 B1 12/2001 Backus
6,354,044 B1 3/2002 Lagace, Jr.
6,371,553 B1 4/2002 Tang
6,405,742 B1 6/2002 Driscoll
6,471,289 B2 10/2002 Aguilar
6,520,574 B1 2/2003 Huang
6,547,324 B1 4/2003 Ammann, Jr.
6,655,736 B1 12/2003 Arenas
D487,297 S 3/2004 Tyler et al.

| | | | |
|---|---|---|---|
| 6,698,827 | B2 | 3/2004 | Le Gette et al. |
| D494,769 | S | 8/2004 | Vigneaud |
| 6,789,557 | B1 | 9/2004 | Wahl, Jr. |
| 6,823,883 | B1 | 11/2004 | Sears |
| 6,824,210 | B2 | 11/2004 | Zheng |
| 6,845,780 | B2 | 1/2005 | Bishirjian |
| 6,899,383 | B2 | 5/2005 | Hwang |
| 6,926,355 | B2 | 8/2005 | Le Gette et al. |
| 6,979,056 | B1 | 12/2005 | Goldszer |
| 7,048,333 | B2 | 5/2006 | Martinez |
| D522,605 | S | 6/2006 | Bishirjian |
| 7,118,172 | B1 | 10/2006 | Pattison-Sheets |
| 7,168,759 | B2 | 1/2007 | Gallegos Geier |
| 7,198,324 | B2 | 4/2007 | Le Gette et al. |
| 7,243,990 | B1 | 7/2007 | Wahl |
| 7,302,957 | B2 | 12/2007 | Ross |
| 7,311,355 | B2 | 12/2007 | Fargason, III |
| 7,316,450 | B2 | 1/2008 | Ayers et al. |
| 7,374,238 | B2 | 5/2008 | Lingwall |
| 7,396,073 | B2 | 7/2008 | Zheng |
| 7,422,009 | B2 | 9/2008 | Rummel et al. |
| 7,427,101 | B1 | 9/2008 | Zernov |
| 2002/0112752 | A1 | 8/2002 | Blakney |
| 2004/0178665 | A1 | 9/2004 | May |
| 2004/0222678 | A1 | 11/2004 | Hansen |
| 2006/0049672 | A1 | 3/2006 | Terrell |
| 2006/0054207 | A1 | 3/2006 | Wootliff |
| 2007/0018486 | A1 | 1/2007 | Ayers et al. |
| 2007/0145792 | A1 | 6/2007 | Miller |
| 2007/0181172 | A1 | 8/2007 | Harrison |

FOREIGN PATENT DOCUMENTS

| | | | | |
|---|---|---|---|---|
| CH | 635393 | A | * | 3/1983 |
| DE | 26 55 028 | A1 | | 6/1978 |
| DE | 31 31 166 | A1 | | 2/1983 |
| DE | 35 360 49 | A1 | | 4/1987 |
| DE | 42 01 743 | A1 | | 10/1992 |
| FR | 2 691 619 | | | 12/1993 |
| GB | 2 052 960 | A | | 2/1981 |
| GB | 2 091 648 | | | 8/1982 |
| GB | 2 216 850 | | | 10/1989 |
| JP | 7 207 962 | | | 8/1995 |
| JP | 2002-209663 | | | 7/2002 |
| WO | WO 82/01984 | | | 6/1982 |
| WO | WO 91/14386 | | | 10/1991 |
| WO | WO 96/39066 | | | 12/1996 |
| WO | WO 2007/018926 | | | 2/2007 |

OTHER PUBLICATIONS

International Search Report and Written Opinoon of the Internatioanl Searching Authority for PCT Application No. PCT/US06/26993, mailed Sep. 25, 2007 (6 pages).

*Swimways Corp.* v. *Tofasco of America, Inc. and Mac Sports*., Civil Action No. 08-cv-00481-RGD-TEM, Defendants' Opposition to Swimways' Motion for a Temporary Restraining Order/Preliminary Injunction, dated Nov. 8, 2008 (38 pages), including Declaration of Michael Aycock in Opposition to Swimways' Motion for a Temporary Restraining Order/Preliminary Injunction, dated Nov. 7, 2008 (32 pages); Declaration of Andrew Frankel in Opposition to Siwmways' Motion for a Temporary Restraining Order/Preliminary Injunction, dated Nov. 6, 2008 (5 pages); Declaration of Gary J. Gorham in Opposition to Swimways' Motion for Temporary/Restraining Order/Preliminary Injunction, dated Nov. 7, 2008 (5 pages); and Exhibits A. 1-A.6 (7 pages) G.1-B.6 (7 pages), C (2 pages), F.1-F.6 (7 pages) G.1-G.7 (8 pages), Q (14 pages) R (9 pages), W (12 pages), Y (3 pages), and BB (3 pages).

*Swimways Corp.* v *Tofasco of America, Inc. and Mac Sport*., Civil Action No. 2:08-cv-00481-RGD-TEM, Reply Memorandum in Support of Swimways' Motion for a Preliminary Injunction, dated Nov. 18, 2008, 25 pages, including Supplemental Declaration of Dr. Pradip N. Sheth, dated Nov. 17, 2008, 13 pages.

*Swimways Corp.* v. *Tofasco of America, inc. and MacSports, Inc.*, Civil Action No. 2:08-cv-00481-RGD-TEM, Order Granting Swimways' Motion for a Preliminary Injunction, dated Nov. 25, 2008 3 pages.

*Swimways Corp.* v. *Tofasco of America, Inc. and MacSports, Inc.*, Civil Action No. 2:08-cv-00481-RGC-TEM, Order Granting Swimways Motion to Extend a Prior Preliminary Injunction, dated Jan. 22, 2009, 3 pages.

*Swimways Corp.* v *Tofasco of America, Inc., and MacSports, Inc.*, Civil Action No. 2:08-cv-00481-RGD-TEM, Order Granting Swimways' Motion to Extend a Prior Preliminary Injunction, dated Mar. 23, 2009, 3 pages.

* cited by examiner

COLLAPSIBLE CANOPY ALONG WITH ARTICLE OF FURNITURE AND METHOD INCORPORATING THE SAME

FIELD OF THE INVENTION

The present invention relates to collapsible furniture and, more particularly, to a collapsible canopy for a chair.

BACKGROUND

Portable chairs such as lawn chairs are very convenient for barbecues, sporting events, days at the beach, and other outdoor pursuits. Lawn chairs have been improved over the years from a simple folding chair to collapsible camping chairs such as that described in U.S. Pat. No. 6,322,138 to Tang. This newer style of collapsible chair is convenient in that it collapses into a relatively small volume, which facilitates transport and storage. However, the storage sleeve, which is often employed to store and transport this type of collapsible chair is thought, by some, to be unwieldy and difficult to use. Thus, at least one area for improvement of collapsible chairs is a more convenient means for storing and transporting the chair in a stowed or collapsed state.

Other improvements in lawn chair technology include the addition of canopy attachments that provide shade and some protection from rain. U.S. Pat. No. 5,080,432 to Connell describes one example of a canopy attachment for a lawn chair. While this is an improvement over previous lawn chairs that provided no shade, it does not provide a canopy attachable to the latest style of collapsible camping or lawn chair, nor does it collapse sufficiently for convenient storage with newer style chairs.

Furthermore, conventional canopy attachments, such as Connell's, fail to provide a means of adjusting the canopy that is adaptable to protect a user from sunlight and precipitation approaching from various angles. For instance, when visiting the beach, one may prefer to face towards the ocean. Facing the ocean generally causes the Sun's orientation relative to the user to vary over the day. Existing canopies are either unadjustable and thus unable to continuously shade the occupant, or in order to shade the occupant the canopy must be lowered to such an extent that the occupant's view is obstructed. Similarly, sporting events dictate that spectators face towards the field of play regardless of weather conditions, such as rain or sleet. This is particularly inconvenient when the rain or sleet is driven by wind. Thus, it would be advantageous to have the ability to adjust the canopy at compound angles relative to the chair's seat portion so that the occupant is more protected from sun and precipitation while still being able to view his or her surroundings. Accordingly, there is still a need for a collapsible canopy structure and collapsible chair and canopy that provides for versatility of adjustment that as yet has not been provided. There is a further need for a collapsible chair and canopy structure with an improved means of storing and transporting the stowed chair and canopy.

SUMMARY

Provided herein is a canopy for an article of furniture, such as a chair, having a seat portion and a back portion. The canopy broadly includes an arm structure and a flexible covering. The arm structure includes an upright member including a proximal end portion extending from the back portion of the chair, a distal end portion, and a medial portion extending therebetween. The arm structure also includes a cantilever member pivotable about the distal end portion and a brace pivotably attached to the cantilever member and selectively positionable along the medial portion, thereby providing angle adjustment of the cantilever member relative to the seat portion.

The canopy may include a pair of the above mentioned arm structures with the flexible covering extending between the pair of arm structures. The flexible covering may include a plurality of panel sections, extending between the pair of arm structures and retained thereto by a pair of tethers or tabs each connecting to one of the cantilever members. The tethers may each be in the form of a pouch attached to the flexible covering. The flexible covering may also include an auxiliary panel aligned with the upright members and including a pair of sleeves or tethers for receiving the upright members therethrough.

The proximal end portion of the upright member may be rotatably or pivotably attached to a mounting fitting securable to the back portion of the chair, whereby the canopy is movable between a stowed state and a deployed state. The mounting fitting may include a retainer having a pair of opposing tangs spaced and configured such that the upright member snaps into the retainer for selectively retaining the upright member in the deployed state.

The arm structures may also each include a slide fitting slidably disposed along the medial portion and a brace pivotably attached to the cantilever member and pivotably attached to the slide fitting, thereby providing angle adjustment of the cantilever member relative to the seat portion. The slide fitting may include a slide retainer for selectively retaining the slide fitting at a desired position along the medial portion. The slide retainer may include a detent or latch mechanism operative to engage the medial portion at discrete locations.

Also contemplated is an article of furniture including a collapsible canopy. The article of furniture includes a chair having a seat portion and a back portion, wherein the chair is configurable between a stowed configuration and a deployed configuration. The article of furniture also includes a canopy movable between a stowed state and a deployed state. The canopy's flexible covering may include a plurality of panel sections, extending between a pair of collapsible arm structures and retained thereto by a pair of tabs each connecting to one of the cantilever members. Preferably, the flexible covering is sized and configured to enclose the chair and the pair of collapsible arm structures when the canopy is in the stowed state and the chair is in the stowed configuration.

A method for deploying a canopy over the seat portion of an article of furniture is also contemplated. The method includes securing a flexible covering to a pair of cantilever arms, moving the pair of cantilever arms to an elevated position over the article of furniture, adjusting the pair of cantilever arms to an angled position relative to the seat portion, and releasably retaining the pair of cantilever arms in the elevated and angled positions. The method may also include releasably retaining the angled position of each cantilever arm independently of the other, and independently of the elevated position.

The foregoing and other features, utilities, and advantages of the invention will be apparent from the following more particular description of the embodiments of the invention as illustrated in the accompanying drawings.

BRIEF DESCRIPTION OF THE DRAWINGS

The accompanying drawings, which are incorporated in and constitute a part of this specification, illustrate embodiments of the present invention and together with the description, serve to explain the principles thereof. Like items in the drawings are referred to using the same numerical reference.

DETAILED DESCRIPTION

The technology of the present application will be explained with reference to the figures. While the canopy is explained with particular reference to certain devices and materials, it should be understood that those devices and materials are exemplary in nature and should not be construed as limiting. Moreover, while described as a canopy for a collapsible chair, the principles described herein are equally applicable to other types of furniture including non-collapsible furniture.

Figure 1:
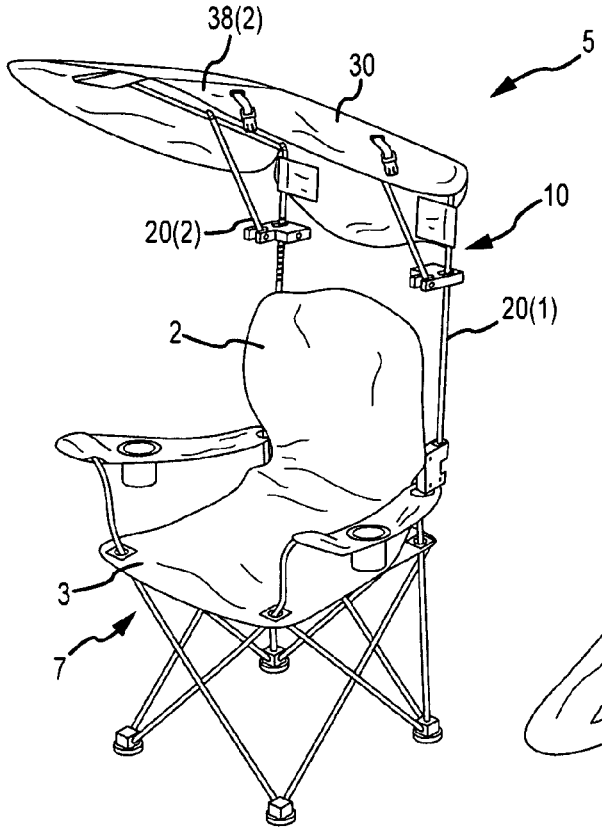
FIG. 1 is a perspective view of a canopy, according to a first exemplary embodiment of the present invention, attached to a typical collapsible chair.
Figure 2:
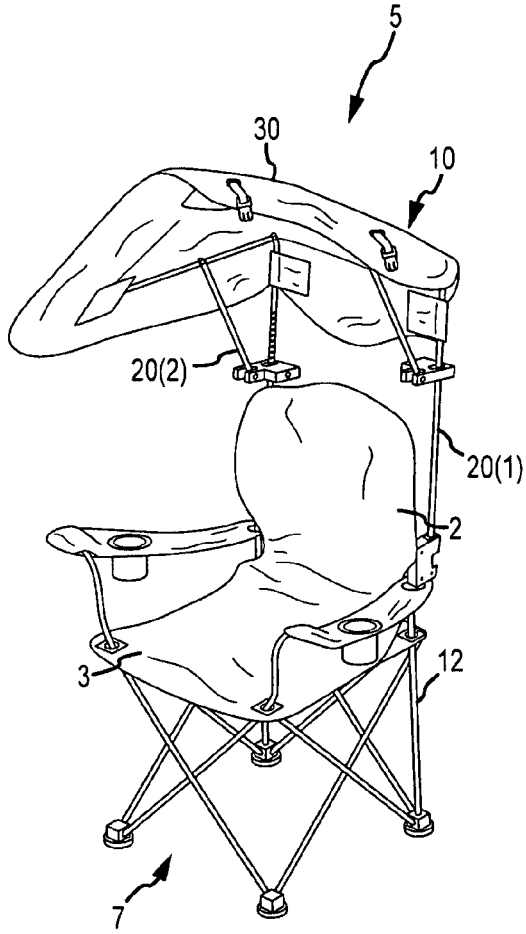
FIG. 2 is a perspective view of the canopy and collapsible chair shown in FIG. 1 with the canopy positioned at a compound angle.

Referring first to FIGS. 1 and 2, article of furniture 5 includes collapsible chair 7 and canopy 10. In this case, chair 7 is a typical collapsible chair with a seat portion 3 and back portion 2 extending upwardly therefrom. Chair 7 also includes back support stanchions 12 to which the canopy support arm assemblies 20(1) and 20(2) are mounted. Canopy support arm assemblies 20 support covering 30, which attaches to and extends between the support arm assemblies. As can be seen in FIG. 2 canopy 10 may be adjusted to suit various conditions, such as, late afternoon sunshine or blowing rain or sleet. As shown in FIG. 2, the support arm assemblies 20 may be independently adjusted relative to one another. For example, support arm assembly 20(2) is adjusted downward relative to support arm assembly 20(1), thereby orienting covering 30 at a compound angle relative to seat portion 3.

Figure 3:
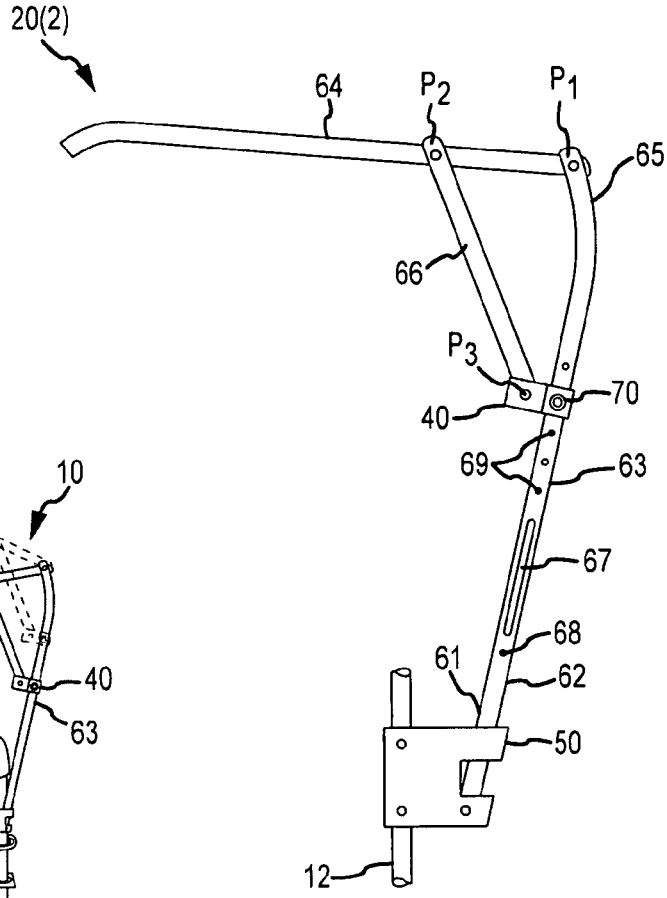
FIG. 3 is a side view in elevation of the support arm assembly as viewed from the inside as shown in FIGS. 1 and 2 with a partial view of the chair back.
Figure 4:
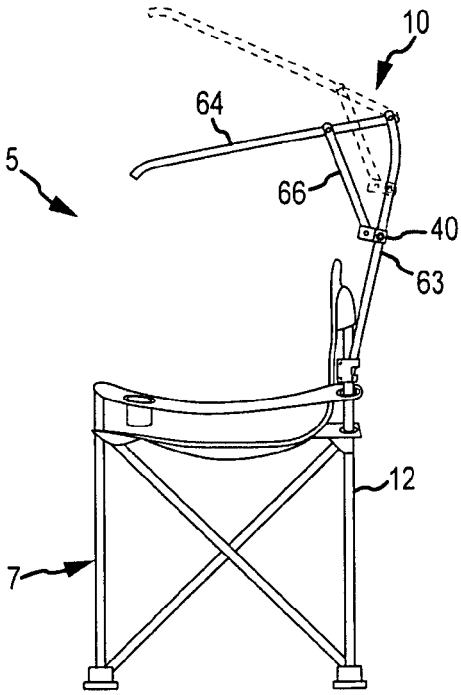
FIG. 4 is a side view in elevation of the canopy and collapsible chair illustrating adjustability of the support arm.

The construction of the support arm assemblies is perhaps best shown in FIG. 3, which is a side view of assembly 20(2) as viewed from between the support arm assemblies (see FIG. 2). In this embodiment, support arm assembly 20(2) includes an upright member 62 that includes a proximal end portion 61, a distal end portion 65, and a medial portion 63 extending therebetween. Cantilever member 64 is pivotally attached to distal end portion 65 of upright member 62 at a first pivot $P_1$. Pivot $P_1$ may be any conventional pivotal connection as are generally known in the art. Brace 66 is pivotally attached to cantilever member 64 at a second pivot $P_2$ and pivotally attached to slide fitting assembly 40 at a third pivot $P_3$. Slide fitting assembly 40 is slidably disposed along medial portion 63 and includes detent assembly 70 (described below) that is operative to engage recesses 67-69. With reference to FIG. 4, moving slide fitting assembly 40 along medial portion 63 causes cantilever arm 64, by way of brace 66, to rotate about pivot $P_1$, thereby providing adjustment of the canopy covering 30 (not shown for clarity). Preferably, upright member 62, cantilever member 64, and brace 66 are constructed from elongate tubing having an obround cross-section. However, one of ordinary skill in the art will recognize that these components may be formed from tubing having other cross-sectional shapes, such as round, rectangle, or square, to name a few. Furthermore, the tubing may be formed of any suitable material, such as but not limited to, aluminum, steel, fiberglass, or other suitable materials. The various components of the assemblies may be connected by any of the multitude of means, which are well known in the art, such as, for example, rivets, nuts and bolts, pins, and the like.

Figure 5:
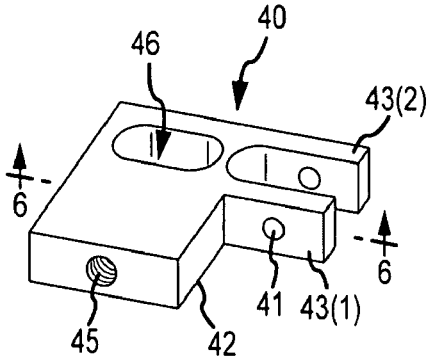
FIG. 5 is a perspective view of the slide fitting shown in FIGS. 1-4.
Figure 6:
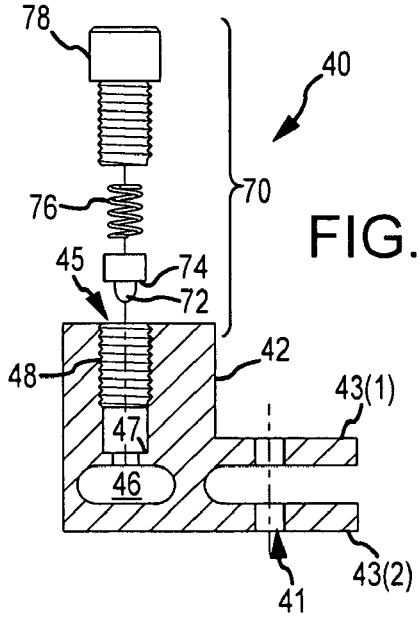
FIG. 6 is an exploded top-view in elevation of the slide fitting assembly with the slide fitting shown in cross-section taken about line 6-6 of FIG. 5.

Referring to FIGS. 5 and 6 it can be seen that slide fitting assembly 40 includes slide fitting 42 and detent assembly 70. Slide fitting 42 includes a slideway 46 that is sized and configured to receive upright member 62. For example, in this case, slideway 46 is obround in shape. Slide fitting 42 also includes a pair of parallel spaced apart clevis arms 43(1) and 43(2) for receiving one end of brace 66. While shown with two parallel spaced apart clevis arms 43(1) and 43(2), one of ordinary skill in the art would recognize in view of the disclosure that the clevis arms may converge or diverge. Moreover, it would be possible to construct the assembly using a single clevis arm 43. Brace 66 is pivotally attached between clevis arms 43 with a clevis pin or fastener inserted through bore 41, which extends through both clevis arms. Detent bore 45 extends orthogonally to slideway 46 and houses detent assembly 70. Detent 72 extends into slideway 46 to engage one of recesses 67-69 disposed along the medial portion 63 of upright member 62. Spring 76 resiliently biases detent 72 toward slideway 46 and thereby urges detent 72 into the selected recess to retain the desired canopy orientation. Spring 76 is retained in detent bore 45 by threaded fastener 78. Detent 72 includes shoulder 74 which mates with bottom surface 47 of bore 45 to limit the extent to which detent 72 may protrude into slideway 46. This arrangement advantageously provides for a more uniform pressure to be exerted by detent 72 on recesses 67-69, thereby easing the operation of the canopy. Preferably, slide fitting 42 and detent 72 are constructed of a durable plastic, such as for example, an acetal homopolymer or ultra-high molecular weight polyethylene (UHMW-PE).

Figure 7:
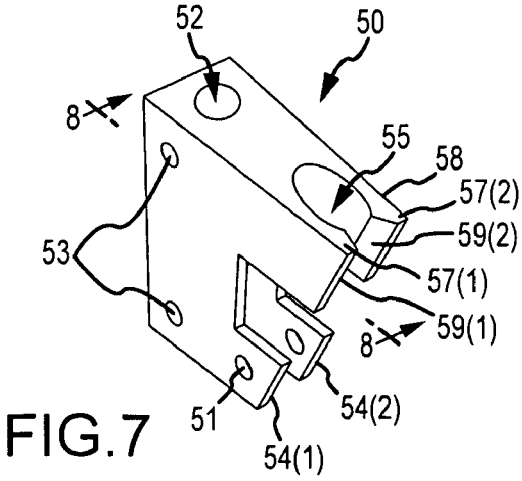
FIG. 7 is a perspective view of the mounting fitting shown in FIGS. 1-4.
Figure 8:
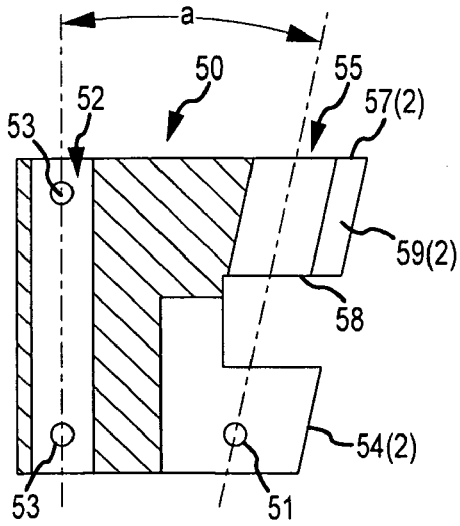
FIG. 8 is a side-view in elevation of the cross-section taken about line 8-8 of the mounting fitting shown in FIG. 7.

Returning briefly to FIG. 3, support arm assembly 20(2) is attached to back support stanchion 12 with mounting fitting 50. With further reference to FIGS. 7 and 8, mounting fitting 50 is described in more detail. Mounting fitting 50 includes bore 52 that is sized and adapted to receive stanchion 12. Cross-bores 53 extend through mounting fitting 50 and orthogonally through bore 52. Cross-bores 53 are sized to receive mounting hardware such as rivets or screws to secure mounting fitting 50 to chair stanchion 12. Mounting fitting 50 includes a pair of parallel spaced apart clevis arms 54(1) and 54(2) for receiving upright member 62 therebetween. While shown with two parallel spaced apart clevis arms 54(1) and 54(2), one of ordinary skill in the art would recognize in view of the disclosure that the clevis arms may converge or diverge. Moreover, it would be possible to construct the assembly using a single clevis arm 54. Each clevis arm 54 includes bore 51 formed therethrough. Bore 51 receives a fastener, such as a pin, that also extends through upright member 62, thereby pivotally attaching upright member 62 to mounting fitting 50. Mounting fitting 50 also includes retainer 58, which is formed as shown in the figures. Retainer 58 includes a pair of opposing tangs 57(1) and 57(2). The surface profile of each tang is such that an opening 55 is formed in the retainer that is congruent with the cross-section of upright member 62. Each tang 57(1) and 57(2) also includes a ramped portion 59(1) and 59(2) respectively. Ramped portions 59 diverge from opening 55, thereby creating a narrow region through which upright member 62 may be pressed. Accordingly, upright member 62 may be pressed or snapped into opening 55 and retained therein by tangs 57. As perhaps best shown in FIG. 8, retainer opening 55 is oriented at an angle "a" relative to bore 52. Retainer 58 may be alternatively constructed with a single tang 57 with an elongated ramp portion 59 such that tang 57 and ramped portion 59 generally form a hook about upright member 62. Preferably, mounting fitting 50 is constructed of a durable plastic such as, for example, an acetal homopolymer or UHMW-PE.

Figure 9B:
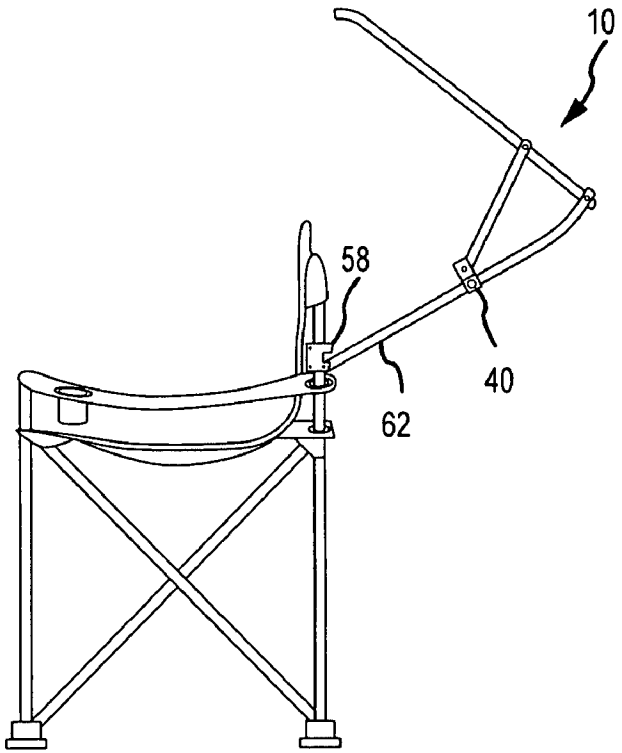
FIG. 9B is a side-view in elevation of the canopy and chair showing the canopy moving between the deployed configuration and a stowed configuration.
Figure 9A:
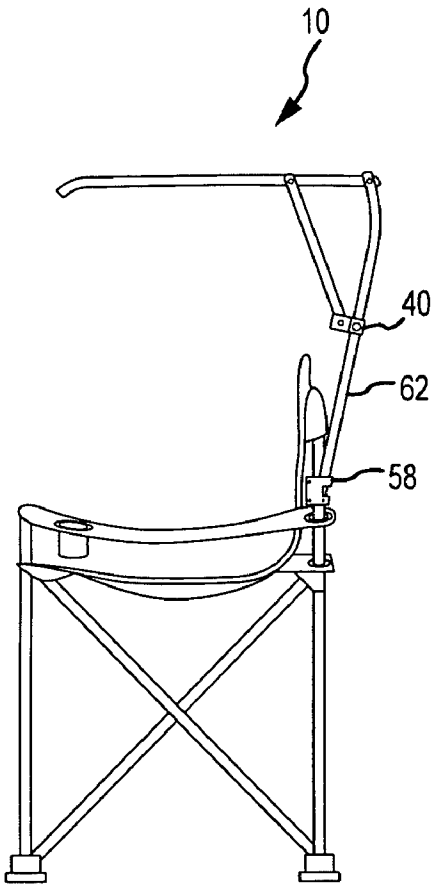
FIG. 9A is a side-view in elevation of the canopy and chair showing the canopy in a deployed configuration.
Figure 9D:
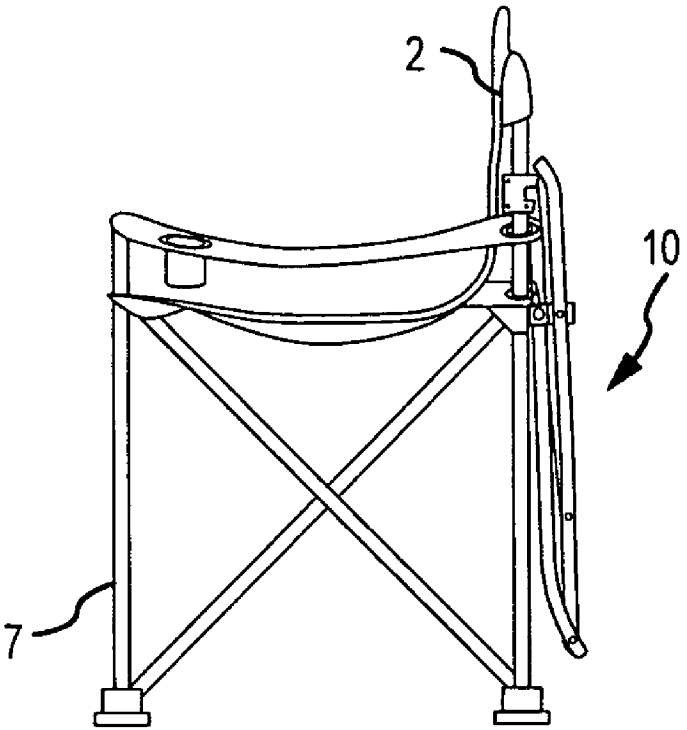
FIG. 9D is a side-view in elevation of the canopy and chair showing the canopy in a stowed configuration.
Figure 9C:
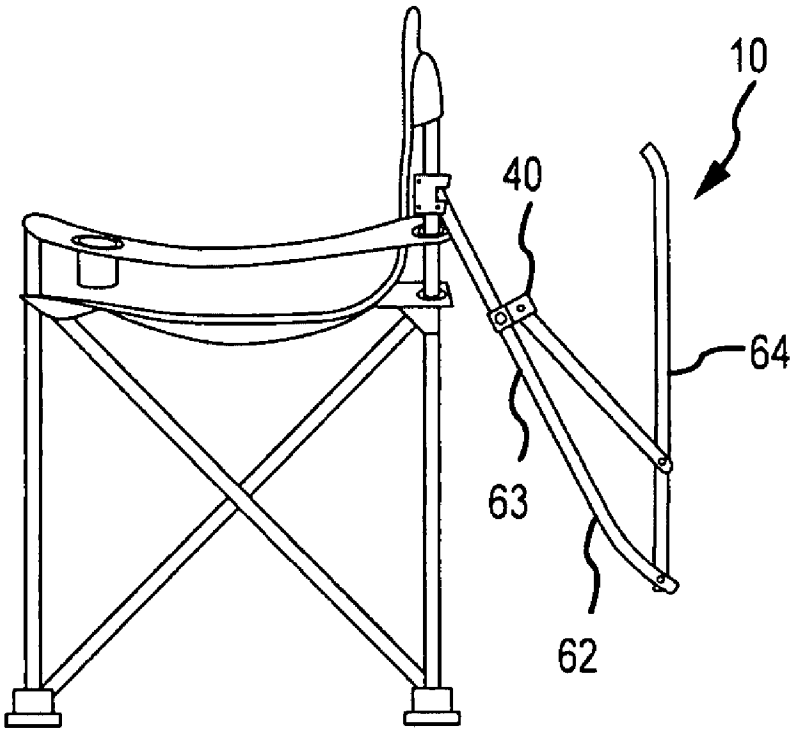
FIG. 9C is a side-view in elevation of the canopy and chair showing the canopy moving between the deployed configuration and a stowed configuration.

Having described the structure of the canopy in some detail, the operation of canopy 10 may now be appreciated with reference to FIGS. 9A-9D. FIG. 9A shows canopy 10 in a deployed configuration with upright member 62 retained in an upright position by retainer 58. Also, cantilever member 64 is retained at a selected orientation by detent assembly 70, which engages one of recesses 69. FIG. 9B illustrates the canopy moving from or to the deployed configuration where upright member 62 is disengaged from retainer 58 thereby allowing canopy 10 to pivot downward or upward. Next, referring to both FIGS. 9B and 9C, slide fitting assembly 40 is moved along medial portion 63 such that upright member 62 and cantilever member 64 are brought into close confronting relationship with one another. Returning momentarily to FIG. 3, upright member 62 includes an elongate recess or depression 67 that facilitates sliding of slide fitting 40 along medial portion 63 by taking pressure off of detent 72 (described above). Finally, as shown in FIG. 9D, canopy 10 is fully collapsed against back portion 2 of chair 7 in a stowed configuration. Upright member 62 may optionally include recess 68 (see FIG. 3) that is engaged by detent assembly 70 to facilitate retaining the canopy in the stowed configuration.

Figure 10A:
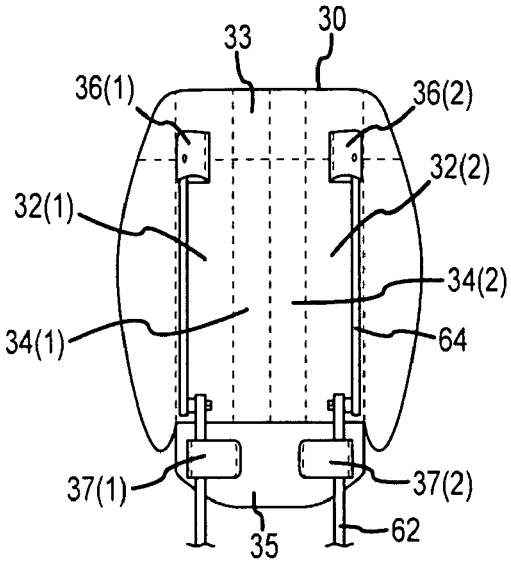
FIG. 10A is a bottom plan-view of the covering shown in FIGS. 1 and 2 along with support arm assemblies shown in a deployed configuration.
Figure 10B:
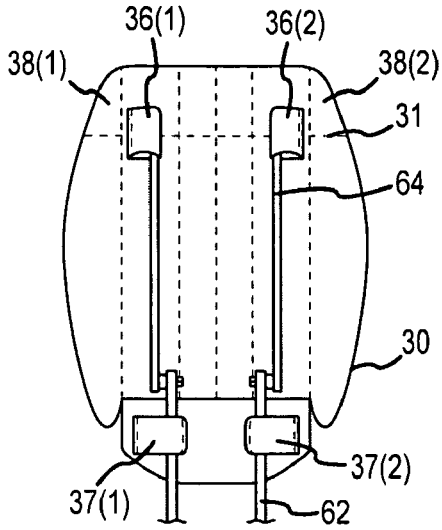
FIG. 10B is a bottom plan view of the covering of FIG. 10A with the support arm assemblies shown in a partially stowed configuration.

Canopy covering 30 is described in more detail with reference to FIGS. 10A and 10B, which show the canopy as viewed from underneath. In this embodiment, covering 30 includes an elongate central section 33 with lateral sections 32(1) and 32(2) hingedly disposed therealong. In this case, central section 33 is comprised of narrower sections 34(1) and 34(2). Each of sections 33 and 32 comprise approximately one third of the covering extending between cantilever members 64 when in the deployed configuration. Hingedly disposed along lateral sections 32(1) in 32(2) are perimeter sections 38(1) and 38(2) respectively. As can be seen in, for example FIG. 1, perimeter sections 38(1) and 38(2) extend downward from lateral sections 32 under the force of gravity. Similarly, sections 38 as well as sections 32 and 33 may optionally extend downward from transverse hinge line 31. By extending downward, the perimeter panels help prevent wind from lifting the canopy. Finally, the covering includes a back panel 35, which is aligned with upright members 62. Back panel 35 provides shade, prevents lift, and facilitates attachment of the covering to the support arm assemblies. The covering is constructed of a durable, preferably waterproof, canvas material. The covering may also include panels formed of corrugated material that is either scored along the dashed hinge lines, as illustrated, or formed of individual panels sewn into the covering.

Covering 30 is attached or tethered to support arm assemblies 20 with pouches 36(1) and 36(2). Cantilever members 64 are received in pouches 36, which are each attached to the underside of flexible covering 30 along a seam. Pouches 36 may be formed of a piece of material folded over on itself and sewn, along a seam, to covering 30. Furthermore, covering 30 may be tethered to the cantilever members with lengths of material attached at one end to covering 30 and cantilever member 64 at the other end. Upright members 62 extend through sleeves 37(1) and 37(2) that are attached to back panel 35. FIG. 10A shows the canopy in a deployed configuration such that pouches 36 extend outwardly from their respective attachment seams. Similarly, upright members 62 are each located at the outermost extent of sleeves 37 respectively. FIG. 10B, on the other hand, illustrates the canopy in a stowed configuration where pouches 36 extend inward from their attachment seams and upright members 62 are located at the innermost extent of sleeves 37. This means of attachment allows the support arm assemblies to move relative to the canopy covering 30 when moved between the deployed configuration and the stowed configuration. Also, this means of attaching canopy covering 32 to the support arm assemblies 20 surprisingly and advantageously allows for flexibility of adjustment for various weather and sunlight conditions by allowing the canopy to be more easily adjusted at compound angles relative to seat portion 3 of chair 7.

Figure 10C:
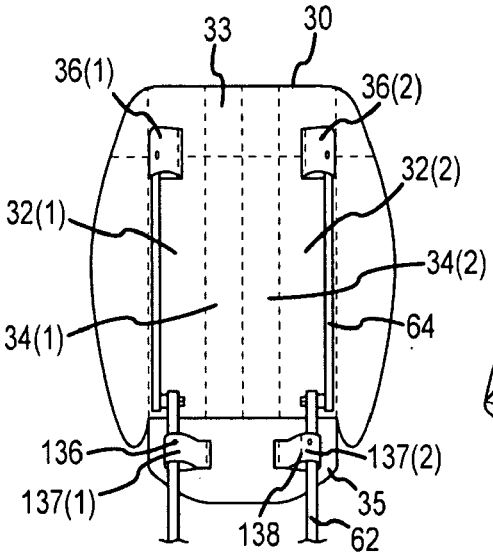
FIG. 10C is a bottom plan-view of the covering illustrating an alternate construction for attaching the upright arms to the covering.

FIG. 10C illustrates an alternate attachment structure for attaching upright members 62 to covering 30. In this construction, upright members 62 extend through tabs, or tethers, 137(1) and 137(2). Furthermore, movement of upright members 62 relative to tethers 137 may be restricted by securing each upright member to its associated tether by a suitable fastener 136. Alternatively, the tether may be constructed such that it fits tightly around the upright member, thereby securing it relative to the tether. This may be accomplished with the addition of stitching 138 to form a tubular portion sized to tightly fit around the upright member. Similar to tethers 36 shown in FIGS. 10A and 10B, tethers 137 allow upright members 62 to move relative to the canopy covering 30 when moved between the deployed configuration and the stowed configuration.

Figure 11:
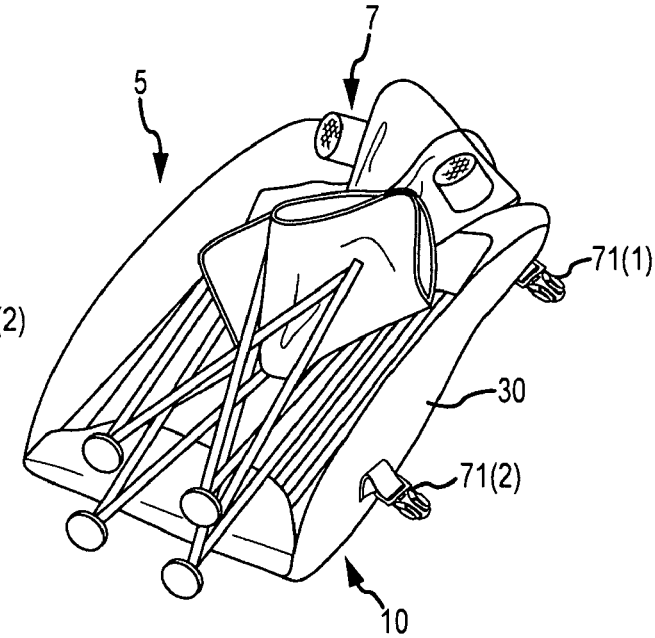
FIG. 11 is a perspective view of the chair and canopy in a collapsed configuration.
Figure 12:
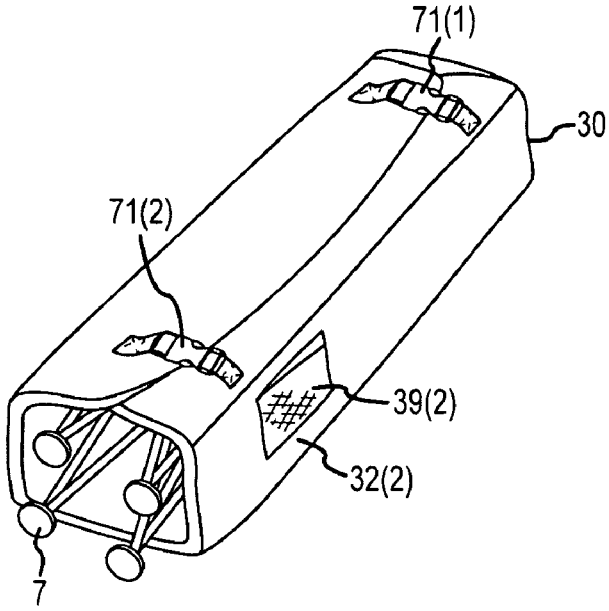
FIG. 12 is a perspective view of the chair and canopy, as viewed from the top, showing the covering surrounding the collapsed chair and support arm assemblies.
Figure 13:
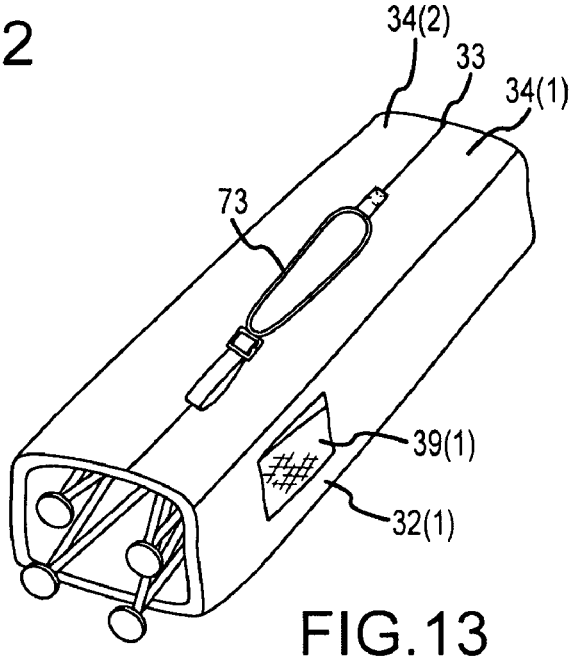
FIG. 13 is a perspective view as viewed from the bottom of the chair and canopy of FIG. 12 illustrating the attachment of the carrying strap.

FIG. 11 shows chair 7 and canopy 10 in the stowed configuration. Canopy covering 30 is sized and configured to contain chair 7 and canopy 10 for convenient storage and transportation of the entire article of furniture 5. Referring to FIG. 12, canopy covering 30 also includes cooperative fasteners 71 that retain canopy cover 30 in a closed configuration that envelops chair 7 and support arm assemblies 20. As shown in FIGS. 12 and 13, canopy 10 may also include a carrying strap 73 attached to the outer surface of covering 30. Also shown in FIGS. 12 and 13 are pockets 39(1) and 39(2) conveniently located on panels 38(1) and 38(2) respectively.

Figure 14:
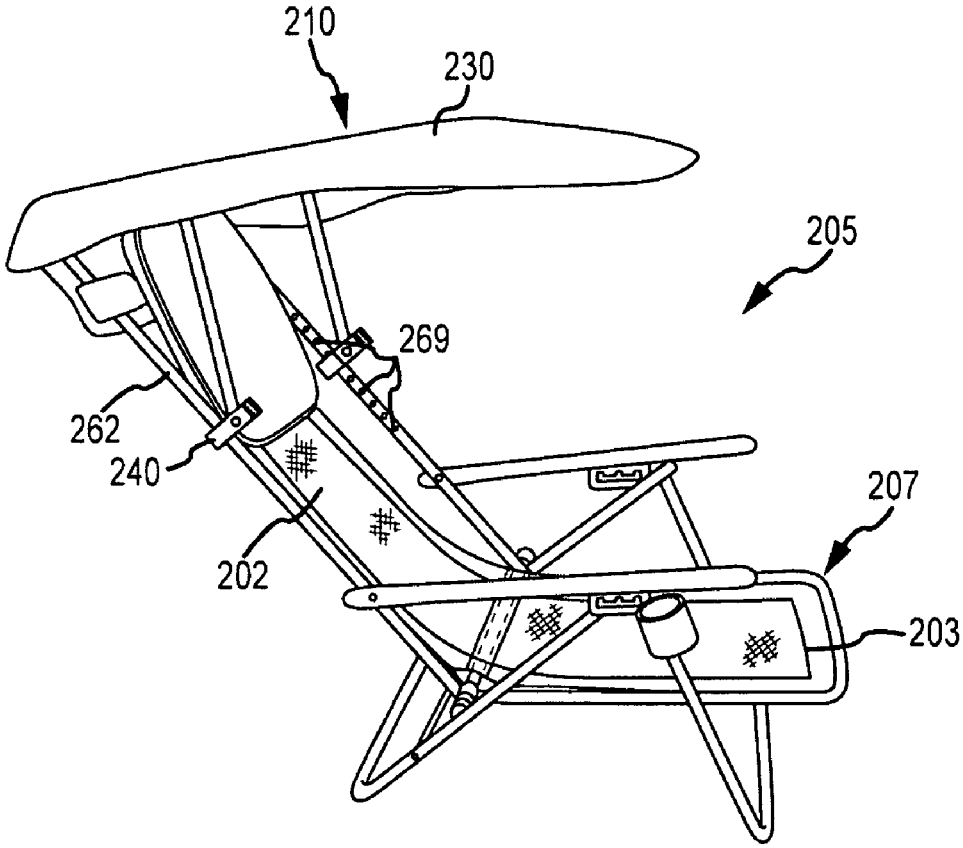
FIG. 14 is a perspective view of a collapsible beach chair including a canopy, according to a second exemplary embodiment of the present invention.

FIG. 14 shows an article of furniture 205 according to a second exemplary embodiment of the present invention including chair 207 and canopy 210. Chair 207 is a typical folding beach chair with a seat portion 203 and a seat back 202. In this embodiment, upright supports 262 are integral with the seat back 202. The construction and operation of canopy 210 is similar to that as described with respect to the first embodiment above. Upright member 262 includes a plurality of recesses 269 which provide additional adjustability because the beach chair configuration has a more reclined back portion 202. Also, due to the increased recline of beach chair 207, covering 230 may be longer to cover more of the seat portion 203. While the embodiments have been described herein with respect to two types of chairs, one ordinarily skilled in the art will appreciate that the teachings of the present application may be adapted to other articles of furniture.

Figure 15:
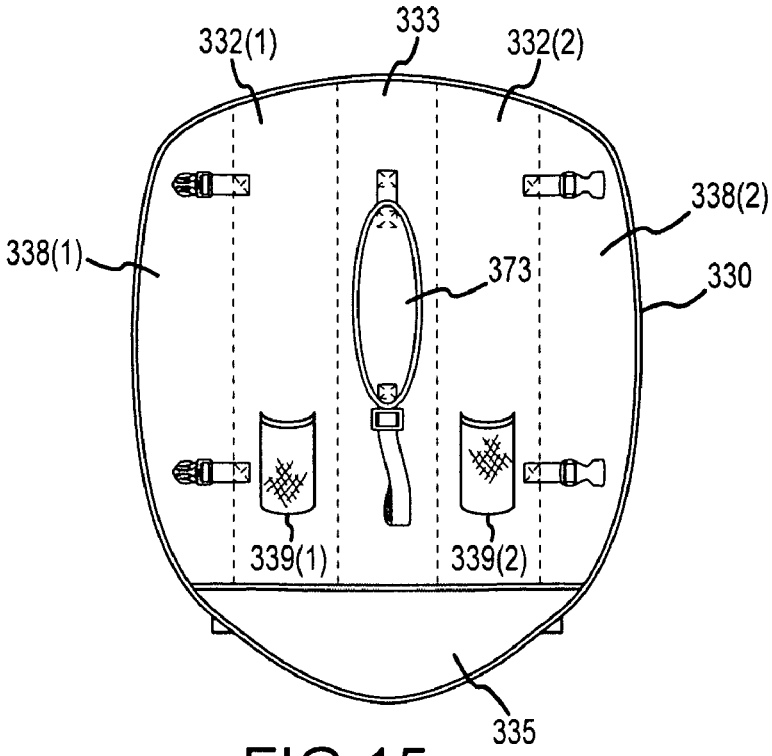
FIG. 15 is a top plan-view of an alternative construction of the covering.
Figure 16:
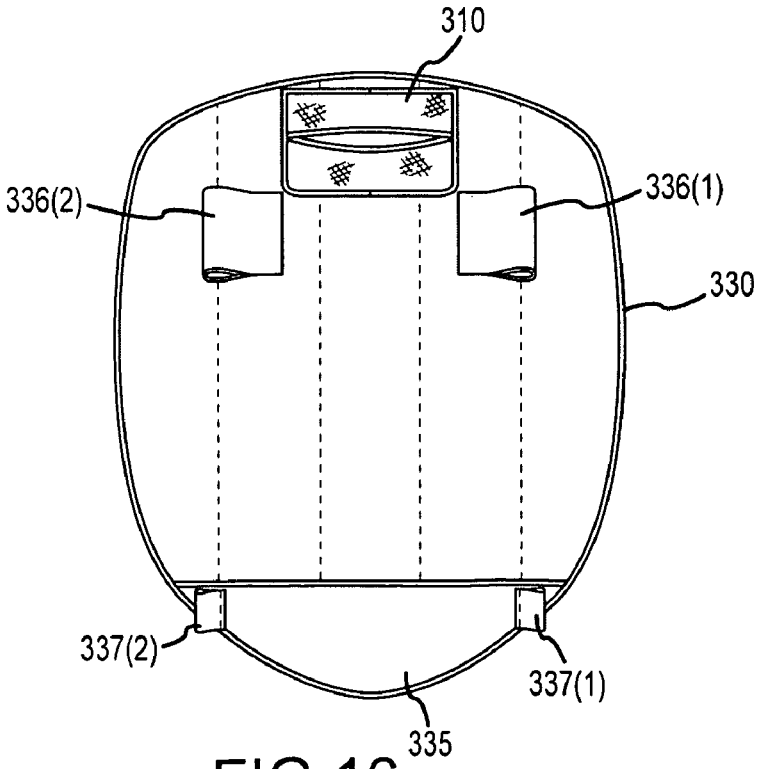
FIG. 16 is a bottom plan-view of the covering shown in FIG. 15.

FIGS. 15 and 16 illustrate an alternative construction for the canopy covering. In this construction, covering 330 includes an elongate central section 333 with lateral sections 332(1) and 332(2) hingedly disposed therealong. Each of sections 333 and 332 comprise approximately one third of the covering extending between cantilever members when in the deployed configuration. Hingedly disposed along lateral sections 332(1) in 332(2) are perimeter sections 338(1) and 338(2) respectively. Covering 330 also includes a back panel 335. Canopy covering 330 may be attached to the support arms in a similar manner to that described above. For example, as shown in FIG. 16, the cantilever arms may be attached to covering 330 via tethers 336 (1) and (2). Similarly, back panel 335 may be secured to the upright members via tethers 337(1) and (2).

Carrying strap 373 is attached to central panel 333 and pockets 339(1) and (2) are attached adjacent the carrying strap on lateral panels 332(1) and (2) respectively. A pocket 310 may also be included on the underside of covering 330 as shown in FIG. 16. Pockets 339 and 310 may be formed of a web material.

Also contemplated, is a method for deploying a canopy covering over an article of furniture having a seat portion. The method broadly includes securing a flexible covering to a pair of cantilever arms, moving the pair of cantilever arms to an elevated position over the article of furniture, adjusting the pair of cantilever arms to an angled position relative to the seat portion, and releasably retaining the cantilever arms in the elevated and angled positions. The angled position of each cantilever arm may be releasably retained independently of the other, and independently of the elevated position.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

What is claimed is:

1. A canopy for use with an article of furniture having, a seat portion and a back portion, said canopy comprising:

(A) a mounting fitting securable to the back portion;

(B) an arm structure including:

(i) an upright member including a proximal end portion pivotably attached to said mounting fitting whereby said upright member is pivotable about a horizontal axis between a stowed state and a deployed state while said mounting fitting is secured to the back portion, a distal end portion, and a medial portion extending therebetween, wherein said mounting fitting includes a retainer having a pair of opposing tangs spaced and configured such that said upright member snaps into said retainer selectively retaining said upright member in the deployed state;

(ii) a cantilever member pivotable about said distal end portion;

(iii) a slide fitting translatable along said medial portion, wherein said slide fitting includes a detent operative to engage said medial portion at discrete locations to selectively retain said slide fitting at a desired position along said medial portion; and (iv) a brace pivotably attached to said cantilever member and pivotably attached to said slide fitting, thereby providing angle adjustment of said cantilever member relative to the seat portion; and (C) a flexible covering supported by said cantilever member.

2. A canopy according to claim 1 including a pair of said arm structures and said flexible covering extending between said pair of arm structures.

3. A canopy according to claim 2, including a pair of tethers each attached at a first end to one of said cantilever arms and secured at a second end to said flexible covering.

4. A canopy according to claim 3 wherein said tether is a pouch.

5. An article of furniture, comprising:

(A) a chair having a seat portion and a back portion extending therefrom, wherein said chair is configurable between a stowed configuration and a deployed configuration;

(B) a canopy including:

(1) a pair of mounting fittings secured to the back portion;

(2) a pair of collapsible arm structures, each including:

(i) an upright member including a proximal end portion rotatably attached to a corresponding one of said pair of mounting fittings, whereby said canopy is movable between a stowed state and a deployed state, a distal end portion, and a medial portion extending therebetween, wherein said mounting fitting includes a retainer having a pair of opposing tangs spaced and configured such that said upright member snaps into said retainer selectively retaining said upright member in the deployed state;

(ii) a slide fitting translatable along said medial portion, wherein said slide fitting includes a detent operative to engage said medial portion at discrete locations to selectively retain said slide fitting at a desired position along said medial portion;

(iii) a cantilever member pivotable about said distal end portion; and (iv) a brace pivotably attached to said cantilever member and pivotably attached to said slide fitting; and (3) a flexible covering, including a plurality of panel sections, extending between said pair of collapsible arm structures and retained thereto by a pair of tabs each connecting to one of said cantilever members.

6. An article of furniture according to claim 5, wherein said flexible covering is sized and configured to enclose said chair and said pair of collapsible arm structures when said canopy is in the stowed state and said chair is in the stowed configuration.

7. A canopy for use with an article of furniture having a seat portion and a back portion, said canopy comprising:

(A) a pair of arm structures, each including:

(i) a mounting fitting securable to the back portion;

(ii) an upright member including a proximal end portion pivotably attached to said mounting fitting, a distal end portion, and a medial portion extending therebetween, wherein said upright member is pivotable about a horizontal axis between a stowed state and a deployed state, and wherein said mounting fitting includes a retainer for selectively retaining said upright member in the deployed state;

(iii) a slide fitting translatable along said medial portion, wherein said slide fitting includes a detent operative to engage said medial portion at discrete locations to selectively retain said slide fitting at a desired position along said medial portion;

(iv) a cantilever member pivotable about said distal end portion; and (v) a brace pivotably attached to said cantilever member and pivotably attached to said slide fitting, thereby providing angle adjustment of said cantilever member relative to the seat portion; and (B) a flexible covering extending between said arm structures.

8. A canopy according to claim 7 wherein said flexible covering includes an auxiliary panel aligned with said upright members and including a pair of sleeves for receiving said upright members therethrough.

9. A canopy according to claim 7, wherein said flexible covering is attached to said pair of arm structures by a pair of tethers each connecting to one of said cantilever members.

10. A canopy according to claim 9 wherein said tethers are each in the form of a pouch attached to said flexible covering.

* * * * *